United States Patent [19]

Godbersen

[11] 3,959,977

[45] June 1, 1976

[54] CONCRETE SLIP FORMING APPARATUS

[76] Inventor: Harold W. Godbersen, Ida Grove, Iowa 51445

[22] Filed: Oct. 21, 1974

[21] Appl. No.: 516,756

[52] U.S. Cl. ..... 61/63; 61/72.2; 425/59; 425/63

[51] Int. Cl.[2] ..... E03F 3/06

[58] Field of Search ..... 425/59, 62–65; 404/2, 105, 118; 61/72.1–72.7

[56] References Cited

UNITED STATES PATENTS

| | | | |
|---|---|---|---|
| 857,588 | 6/1907 | Boyle | 425/59 |
| 1,362,952 | 12/1920 | McQueary | 404/2 |
| 2,093,766 | 9/1937 | Rich | 404/118 |
| 2,692,092 | 10/1954 | Kinsinger | 61/72.6 |
| 2,969,576 | 1/1961 | Fuller | 425/59 |
| 3,193,901 | 7/1965 | Lee et al. | 425/64 |
| 3,646,767 | 3/1972 | Shelley | 61/72.2 |
| 3,684,030 | 8/1972 | Lucero | 61/72.5 |
| 3,773,874 | 11/1973 | Long | 425/64 |

*Primary Examiner*—Robert D. Baldwin
*Assistant Examiner*—John McQuade
*Attorney, Agent, or Firm*—Henderson, Strom & Sturm

[57] ABSTRACT

Apparatus for slip-forming a pipe or drainage trench including a leading cutter which is attached to the front of a prime mover for digging a trench. A following cutter is also attached to the front of the prime mover, but behind the leading cutter to thereby level off the surface of the ground along the top of the trench. A rigid concrete shaping apparatus including a portion overlying the trench also includes a rigid tubular portion which is disposed within the trench. A roll of flexible plastic material is connected to the apparatus and this plastic material is sealingly connected at one end thereof to a source of air pressure which causes the plastic to inflate to a tubular shape. This plastic is thereby maintained in an inflated condition and extends along the length of the trench to a point inside of the tubular portion of the concrete shaping apparatus, at which point the plastic is pinched by rollers to thereby maintain the pressure within the inflated portion of the flexible tube. One end of the rolled portion of the roll of plastic extends down through one end of the tubular portion of the concrete shaping apparatus, through the rollers and out through the other end of the tubular portion of the shaping apparatus to connect to the source of air pressure. The prime mover moves slowly ahead as concrete is continually supplied to a hopper on the concrete shaping apparatus, which apparatus fills the trench with concrete in a plastic state and forms a concrete structure with an open tubular center. The plastic material unrolls and inflates inside of the hollow concrete structure formed to thereby prevent the concrete on the top of the hollow open tubular center from collapsing. Once the concrete has cured and hardened, the pressure in the plastic tube can be relieved and the tube removed. The formed pipe or drainage structure is then complete.

11 Claims, 9 Drawing Figures

CONCRETE SLIP FORMING APPARATUS

BACKGROUND OF THE INVENTION

The present invention relates generally to a slip-forming device and more particularly to an apparatus for slip-forming a concrete pipe or drainage structure.

Concrete pipes and concrete drainage structures are very desirable because they are very strong and durable and they do not corrode like some similar metal structures do. These concrete structures are, however, relatively quite heavy and difficult to handle and transport. For this reason, there have been many inventions directed to methods and machines for forming these structures in the place where they are to be used, whereby handling and transportation is substantially obviated. One such invention for forming a culvert is shown in U.S. Pat. No. 1,362,952.

It is further very desirable to be able to slip form a continuous pipe in much the same way that other concrete structures have been known to be formed, for example as shown in U.S. Pat. No. 2,664,797 to a sidewalk paver and U.S. Pat. No. 3,606,827 to a concrete curb laying machine. The slip-forming of pipes, culverts and other structures having hollow interiors, however, pose significant problems, since the weight of the concrete when in a plastic condition overlying a hollow interior will cause a collapse of concrete into the hollow space, unless something is present to prevent this from happening. One solution to this problem has been to provide a rigid hollow insert, but this solution is a quite expensive one. Another solution has been to utilize air pressure to the hollow interior such as shown in U.S. Pat. No. 2,937,429, but sealing of the hollow interior space has been a real problem. Additionally, culverts and drainage structures having hollow openings which lead to the outside perimeter of such structures cannot be formed with the types of apparatus like that shown in U.S. Pat. No. 2,937,429. There is consequently a need for an apparatus which can both slip-form pipes and also drainage structures. SUMMARY OF THE INVENTION The present invention relates to an apparatus for continuously slip-forming concrete structures having hollow interiors such as pipes and drainage structures. A rolled up and flattened flexible tube is continuously supplied by means of a new and novel structure to a concrete forming and shaping device such that the hollow concrete structure formed thereby has a section of the flexible tube therein. A source of air pressure is connected to one end of the flexible tube to thereby inflate the tube and thereby cause the air pressure within the tube to hold the wet and plastic concrete in place until such time that the concrete cures enough to place rigid enough to no longer need support.

An object of the present invention is to provide an apparatus for making both pipes and drainage structures in the place where they are to be used.

Another object of the invention is to provide a slip-forming apparatus for forming hollow concrete structures wherein pressure prevents the walls of such concrete structure from collapsing before the concrete has cured.

A further object is to provide an apparatus for unrolling and inflating a sealed flexible tube simultaneously with a slip-forming process.

Other objects, advantages and features of this invention will become readily apparent by reference to the following description when taken in conjunction with the accompanying drawings.

DESCRIPTION OF THE PREFERRED EMBODIMENT

Figure 1:
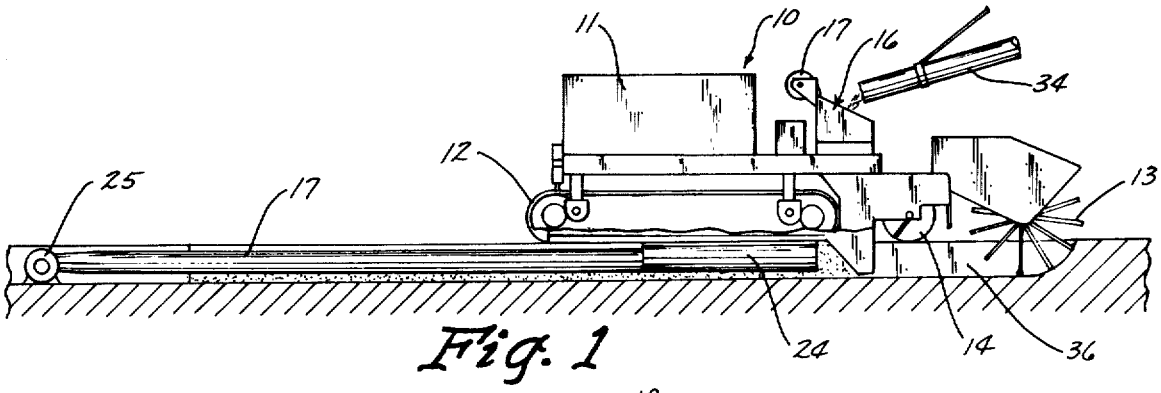
FIG. 1 shows a side view of the slip forming apparatus of the present invention in operation.

Referring now to the drawings wherein like reference numerals designate identical or corresponding parts throughout the several views, FIG. 1 shows the slip-forming apparatus 10 of the present invention in operation. The components of the present invention are all connected to a prime mover 11, this particular prime mover 11 being of a type having endless tracks 12. Connected to the front end of the vehicle 11 is a forward trench trimmer or cutter 13. A following cutter 14 serves to level out the surface surrounding the trench formed by the leading trench trimmer or cutter 13. A slip-forming unit 16 can be best seen in FIG. 3, but its placement on the vehicle 11 can be clearly seen in FIGS. 1, 2 and 7. A roll of plastic material 17 is disposed upon a rod 18 near the top of the slip-forming unit 16. This plastic material 17 can be of a very light gauge, for economy, but can also be of a heavier plastic material if desired. The plastic material is disposed under a first roller 19 and up and between a first roller 19 and a second roller 21. The roll of plastic material 17 further funneled into funnelling structure 22 and into a conduit 23. The funnelling structure 22 serves to roll up the plastic material 17 such that it will easily enter the conduit 23. The other end of the plastic material is connected to a compressor 25 which supplies air pressure at whatever pressure is required under the circumstances. For the purpose of example only and not of limitation, an air pressure within a range of ¼ psi to 12 psi has been found to be an adequate pressure under ordinary circumstances.

The sheet of plastic material 17 is tubular in shape when inflated at a low pressure. The conduit 23 leads to a cylindrical shaped structure 24, which has disposed therein a pair of rollers 26 and 27. The bottom roller 26 is pivotally fastened at a fixed pivotal axis with respect to the cylindrical structure 24. The top roller 27 is rotatably disposed on one end of a U-shaped linkage 28. This linkage 28 is pivotally connected at a point 29 on one end of the U-shaped member 28 to the top of the concrete shaping structure 33. This linkage 28, and ultimately the roller 27 is biased downwardly by gravity and is limited in its downward movement by a stop bar 31 which extends across the interior of the tube 24 and is affixed at each end to the tube 24. Consequently, the roller 27 pinches the flexible tube material 17 at a point 32 so as to maintain the air pressure in the flexible tube 17 between this point 32 and the pump or compressor 25. Alternatively, the pinch rollers 26 and 27 could be mounted along fixed axes within the tube 24 rather than utilize the pivot 29 if a solid pipe rather than a drainage structure with a top opening 35 was desired to be formed.

Figure 5:
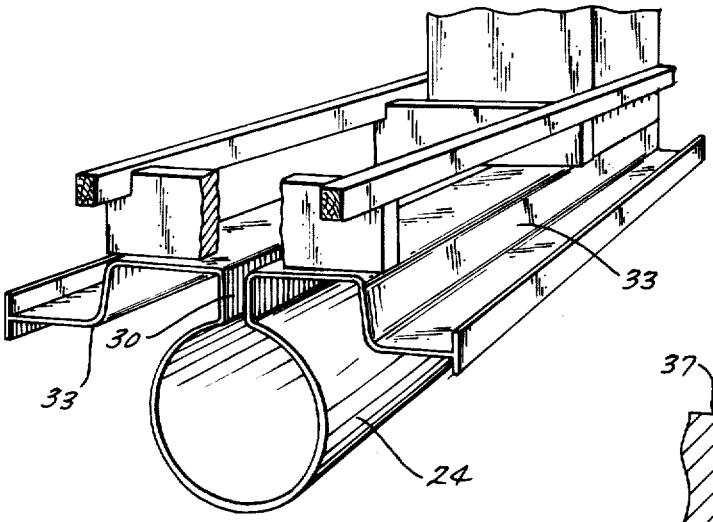
FIG. 5 is a partial perspective view of the other side of that portion of the invention shown in FIG. 3.
Figure 7:
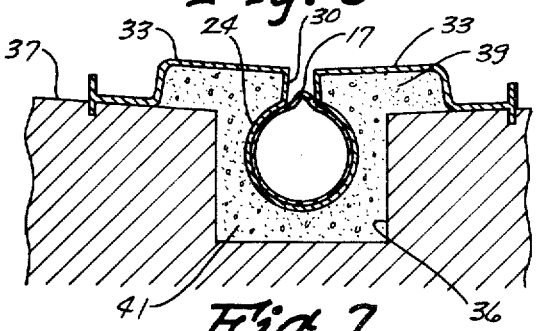
FIG. 7 is a cross-sectional view taken along line 7—7 of FIG. 4 showing the concrete shaping mechanism of the present invention.

It can be seen most easily from FIGS. 5 and 7 that a concrete shaping structure 33 is integrally connected to the cylindrical structure 24, which also forms a part of the concrete shaping means. A slot 30 in the concrete shaping structure 33 is present to form the opening 35 in the top of the finally formed drainage structure 41. The slot structure 30, would, of course, be omitted from the concrete shaping structure 33 if a solid pipe without the top opening was desired to be formed. It is noted also that the slot 30 is very slightly tapered, the top width thereof being slightly less than the bottom width thereof so that solids tend to more readily drop down through the slot.

Figure 2:
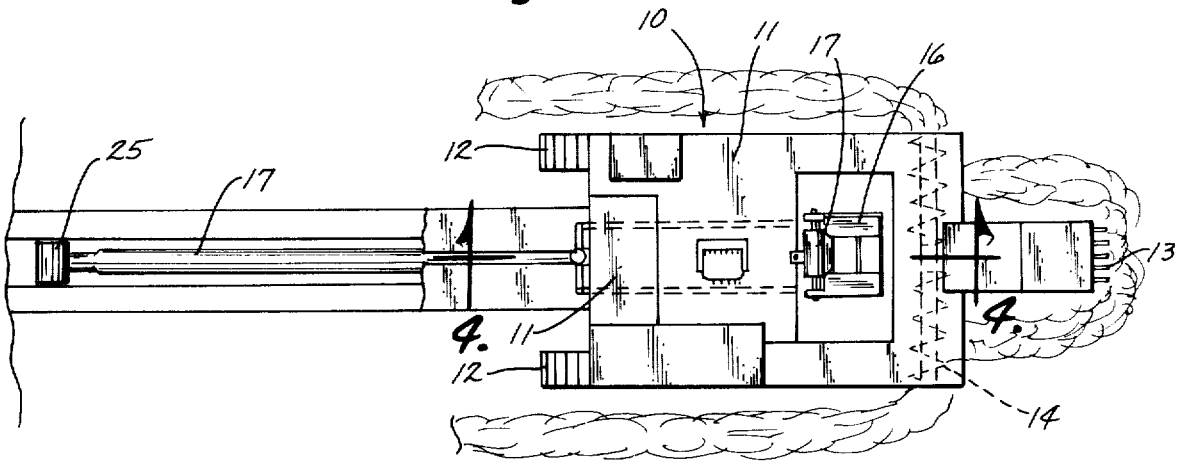
FIG. 2 shows a top plan view of the present invention in operation as shown in FIG. 1.
Figure 3:
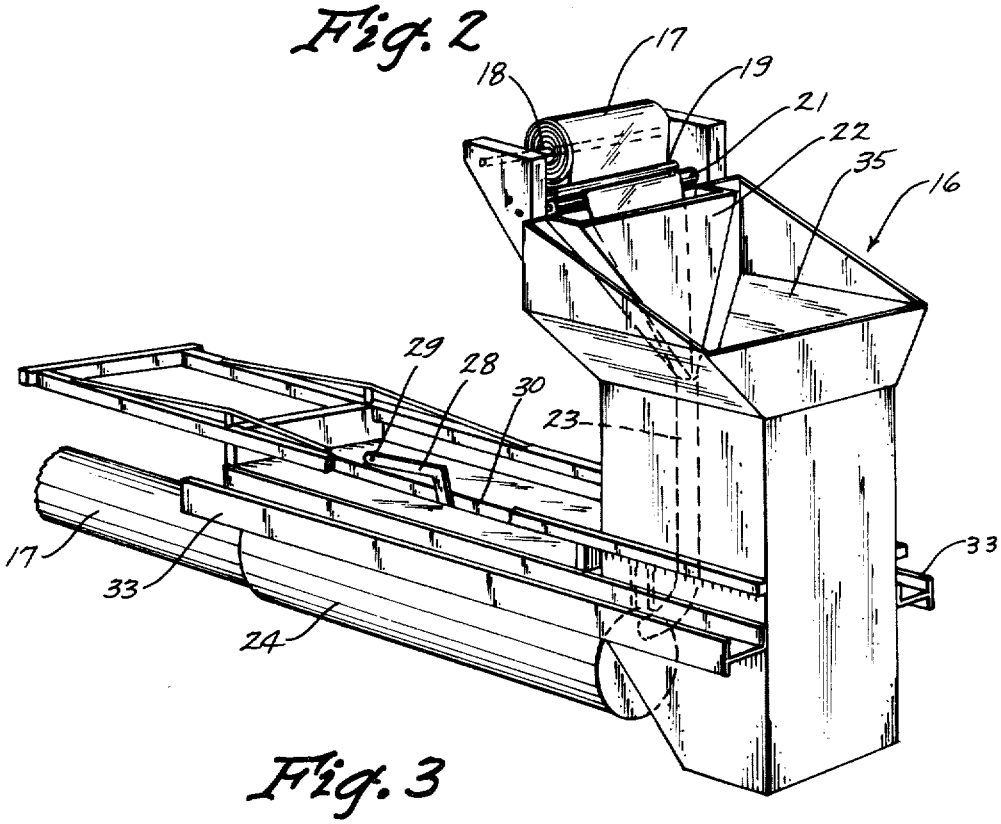
FIG. 3 is a perspective view of a most important part of the instant invention.
Figure 4:
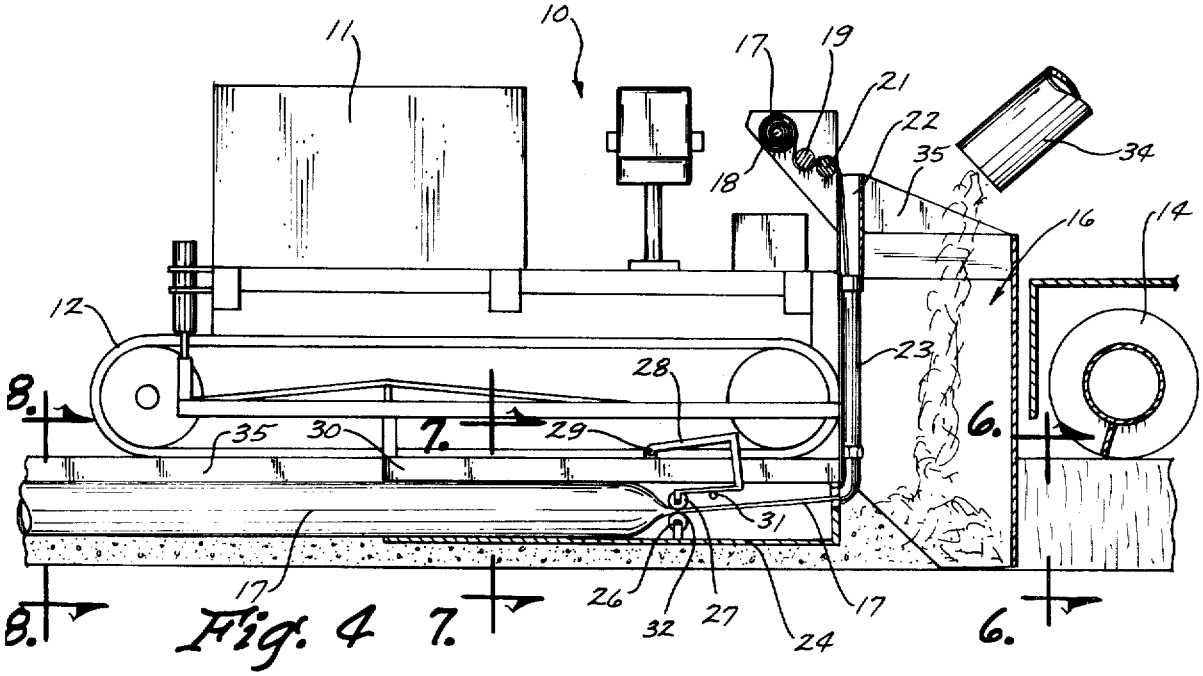
FIG. 4 is a cross-sectional view taken along line 4—4 of FIG. 2.
Figure 6:
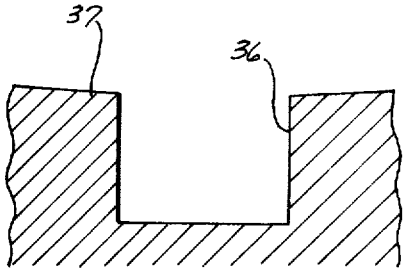
FIG. 6 is a cross-sectional view of a trench taken along line 6—6 of FIG. 4.
Figure 8:
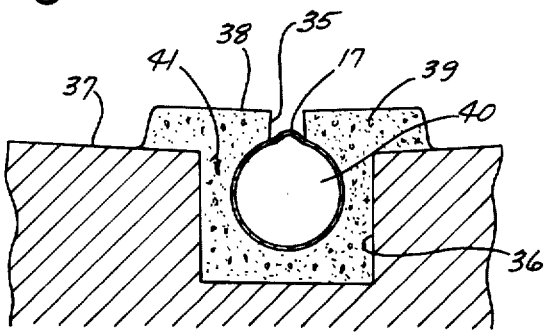
FIG. 8 is a view taken along line 8—8 of FIG. 4 and showing an inflated tube within the concrete structure.
Figure 9:
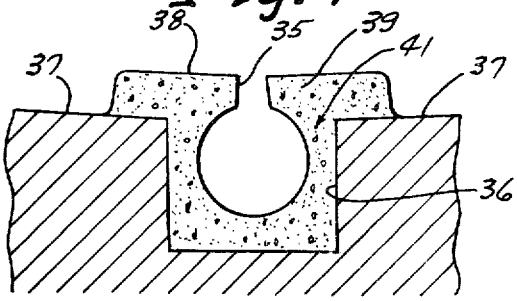
FIG. 9 is a view similar to FIG. 8 but showing the concrete in a cured condition whereby the inflated plastic tube is removed.

In operation, the present device is initially set up as shown for example in FIG. 1. A spout 34 or other source of a supply of concrete in a wet and plastic condition dumps concrete into a hopper 35 of the concrete forming apparatus 16. The concrete then flows downwardly through the hopper 16 and under the concrete shaping structure 33 and around the cylindrical shaping structure 24, which forms a part thereof. As the vehicle 11 moves forwardly or to the right as shown in FIG. 1, the cutter 13 digs a trench 36 as shown in FIG. 6 and the cutter 14 levels off the top 37 of the trench 36. The concrete shaping structure 33, including the cylindrical structure 24 forms a concrete structure of a hollow configuration as the vehicle 11 passes thereover, for example, as best seen in FIG. 7. In FIG. 7 it can be seen also that the flexible member 17 is inflated within the cylindrical structure 24 and this inflated portion of the flexible tubular structure 17 extends back to the pump 25 as shown in FIG. 2. Consequently the pressure within the inflated flexible material 17 holds up the top portions 38 and 39 (FIG. 8), which would otherwise fall downwardly into the open space 40 if the inflated flexible tube 17 were not present under pressure.

Once the concrete in the trench 36 has cured sufficiently, for example after a couple of hours under normal circumstances, the inflated continuous tube 17 can be removed and a drainage structure 41 of concrete has then been formed.

It is noted that a very effective and efficient slip-forming device has been disclosed herein, which accomplished all of the aforementioned objects. Obviously many modifications and variations of the present invention are possible in light of the above teachings. It is therefore to be understood that, within the scope of the appended claims, the invention may be practiced otherwise than as specifically described.

I claim:

1. Apparatus for forming elongated hollow concrete structures comprising:

an elongated flexible tube;

a source of pressure sealingly connected to the interior of said tube;

means holding another portion of said tube substantially closed at all times to thereby cause a section of the tube to be inflated;

form means extending over a portion of said tube said form means including a tubular shaped section, said flexible tube having a portion of its inflated length disposed in said tubular shaped section and conforming to the interior shape of said tubular shaped section, said holding means being attached to said form means;

means connected to the form means for continuously supplying concrete in a plastic condition to said form means;

means connected to said form means for moving said form means along said tube to thereby shape the concrete; and means connected to said concrete supplying means for providing a continuous supply of flexible tubing to said tubular shaped section of said form means including a roll of flattened flexible tubing and means for guiding said flattened flexible tubing to said holding means, said guiding means comprising a conduit connected at one end thereof to a funnelling means for funnelling said flattened flexible tubing into a rolled shape into said conduit, the other end of said conduit being connected to one end of said tubular shaped section of said form means to thereby guide said flexible material to said holding means.

2. Apparatus as defined in claim 1 wherein a portion of the inflated length of the flexible tube lies outside of the tubular shaped section of the form means.

3. Apparatus as defined in claim 1 wherein said holding means comprises a roller means disposed on each side of said substantially closed portion of the tube and connected to the form means to thereby hold this substantially closed portion in such closed position.

4. Apparatus as defined in claim 1 wherein said tubular shaped section of said form means has an opening along the length thereof.

5. Apparatus as defined in claim 4 wherein said opening is along the top of said tubular shaped section of the form means.

6. Apparatus as defined in claim 1 wherein a trenching means for digging a trench is disposed on the forward end of said moving means.

7. Apparatus as defined in claim 6 wherein a leveling means is attached to said moving means at a point between said trenching means and said form means for thereby leveling off the top of the trench formed by said trenching means.

8. Apparatus as defined in claim 1 wherein said holding means comprises a roller means disposed on each side of said substantially closed portion of the tube to thereby hold the substantially closed portion in such closed position.

9. Apparatus as defined in claim 8 wherein said funnelling means comprises a container having sidewalls and an opening at one end thereof, the other end of said container having an opening therein which is substantially smaller than said one end, said other end of the funnelling means being the end which is connected to said one end of the conduit.

10. Apparatus for forming elongated hollow concrete structures comprising:

an elongated flexible tube;

a source of pressure sealingly connected to the interior of said tube;

form means extending over a portion of said tube, said form means including a tubular shaped section having an opening along the top thereof, said flexible tube having a portion of its inflated length disposed in said tubular shaped section and conforming to the interior shape of said tubular shaped section;

means connected to the form means for holding another portion of said tube substantially closed at all times to thereby cause a section of the tube to be inflated, said holding means including a roller rotatably mounted along an axis fixed with respect to said tubular shaped section and a second roller being rotatably mounted on a linkage member, said linkage member extending from the inside of said tubular shaped section, through said opening, and being further pivotally attached at a point outside of said tubular shaped section to said form means;

means connected to the form means for continuously supplying concrete in a plastic condition to said form means; and means connected to said form means for moving said form means along said tube to thereby shape the concrete.

11. Apparatus as defined in claim 10 wherein the axis of rotation of said rollers and the pivotal axis of said linkage member are parallel with respect to each other.

* * * * *